US011776505B2

(12) United States Patent
Ye et al.

(10) Patent No.: US 11,776,505 B2
(45) Date of Patent: Oct. 3, 2023

(54) GAMMA DEBUGGING METHOD AND APPARATUS

(71) Applicant: KunShan Go-Visionox Opto-Electronics Co., Ltd, Jiangsu (CN)

(72) Inventors: Shuai Ye, Kunshan (CN); Haozhi Niu, Kunshan (CN); Tiegang Wang, Kunshan (CN)

(73) Assignee: KunShan Go-Visionox Opto-Electronics Co., Ltd, Kunshan (CN)

( * ) Notice: Subject to any disclaimer, the term of this patent is extended or adjusted under 35 U.S.C. 154(b) by 0 days.

(21) Appl. No.: 17/859,341

(22) Filed: Jul. 7, 2022

(65) Prior Publication Data

US 2022/0351705 A1 Nov. 3, 2022

Related U.S. Application Data

(63) Continuation of application No. PCT/CN2021/087144, filed on Apr. 14, 2021.

(30) Foreign Application Priority Data

Jun. 29, 2020 (CN) ..... 202010610314.9

(51) Int. Cl.
*G09G 5/10* (2006.01)

(52) U.S. Cl.
CPC ..... *G09G 5/10* (2013.01); *G09G 2320/064* (2013.01); *G09G 2320/0673* (2013.01); *G09G 2360/16* (2013.01)

(58) Field of Classification Search
CPC ..... G09G 5/10; G09G 2320/064; G09G 2320/0673; G09G 2360/16; G09G 3/3241; G09G 3/006; G09G 3/2007
See application file for complete search history.

(56) References Cited

U.S. PATENT DOCUMENTS 8,279,351 B2 * 10/2012 Bakhmutsky ..... H04N 9/69 345/589
8,456,482 B2 * 6/2013 Furui ..... H04N 9/3182 345/581

(Continued)

FOREIGN PATENT DOCUMENTS

CN 107591131 A 1/2018
CN 108257560 A 7/2018

(Continued)

OTHER PUBLICATIONS

International Search Report dated Jul. 15, 2021, in corresponding International Application No. PCT/CN2021/087144, 6 pages (with English Translation).

(Continued)

*Primary Examiner* — Rodney Amadiz
(74) *Attorney, Agent, or Firm* — Maier & Maier, PLLC

(57) ABSTRACT

A gamma debugging method includes: according to a duty cycle and gamma data corresponding to a first display brightness level, and a duty cycle corresponding to a second display brightness level, or according to the duty cycle and the gamma data corresponding to the first display brightness level, and gamma data corresponding to the second display brightness level, determining maximum brightness corresponding to an inserted display brightness level and a duty cycle corresponding to the inserted display brightness level; and determining whether a binding-point grayscale at the inserted display brightness level is greater than a preset grayscale threshold, and when the binding-point grayscale at the inserted display brightness level is greater than the preset grayscale threshold, calculating, according to a preset calculation formula, a gamma register value corresponding to the binding-point grayscale at the inserted display brightness level.

17 Claims, 5 Drawing Sheets

(56) References Cited

U.S. PATENT DOCUMENTS

| | | | | |
|---|---|---|---|---|
| 10,249,245 | B1 * | 4/2019 | Hwang | G09G 3/3258 |
| 10,460,655 | B2 * | 10/2019 | Zhang | H04N 9/69 |
| 11,145,247 | B2 * | 10/2021 | Jiang | G09G 3/3225 |
| 2014/0125714 | A1 | 5/2014 | Pyo | |
| 2020/0234655 | A1 * | 7/2020 | Bian | G09G 3/2003 |

FOREIGN PATENT DOCUMENTS

| | | | |
|---|---|---|---|
| CN | 108550345 | A | 9/2018 |
| CN | 109036327 | A | 12/2018 |
| CN | 109584818 | A | 4/2019 |
| CN | 109637475 | A | 4/2019 |
| CN | 109979390 | A | 7/2019 |
| CN | 110534054 | A | 12/2019 |
| CN | 110675838 | A | 1/2020 |
| CN | 110738960 | A | 1/2020 |
| CN | 110767138 | A | 2/2020 |
| CN | 111192554 | A | 5/2020 |
| CN | 111754912 | A | 10/2020 |
| KR | 10-2013-0055257 | A | 5/2013 |
| KR | 10-2019-0031744 | A | 3/2019 |

OTHER PUBLICATIONS

First Office Action dated Mar. 24, 2022, corresponding to Chinese Application No. 202010610314.9; 10 pages, (with machine-generated English Translation).

* cited by examiner

GAMMA DEBUGGING METHOD AND APPARATUS

CROSS-REFERENCE TO RELATED APPLICATIONS

This application is a continuation of International Patent Application No. PCT/CN2021/087144, filed on Apr. 14, 2021, which claims priority to Chinese Patent Application No. 202010610314.9 filed on Jun. 29, 2020, the disclosures of both of which are incorporated herein by reference in their entireties.

TECHNICAL FIELD

Embodiments of the present application relate to the field of display technology, for example, a gamma debugging method and apparatus.

BACKGROUND

With the development of display technology, an increasingly high requirement is imposed on the image quality of display products.

The image quality of a display panel is generally improved by increasing the number of gamma debugging groups. However, the above solution has the case where a long time for gamma debugging in a production line affects a production capacity of the production line.

SUMMARY

The present application provides a gamma debugging method and apparatus and a display panel to reduce the number of binding-point grayscales for gamma debugging, shorten the time of the display panel for gamma debugging, and improve a production capacity of a production line.

In a first aspect, embodiments of the present application provide a gamma debugging method which includes steps described below.

A duty cycle and gamma data corresponding to a first display brightness level and a duty cycle and gamma data corresponding to a second display brightness level in a pulse-width modulation (PWM) dimming interval are acquired. The gamma data includes a brightness and a gamma register value corresponding to a binding-point grayscale. The first display brightness level is a maximum display brightness level in the PWM dimming interval, and the second display brightness level is a minimum display brightness level in the PWM dimming interval, or the first display brightness level is a minimum display brightness level in the PWM dimming interval, and the second display brightness level is a maximum display brightness level in the PWM dimming interval.

According to the duty cycle and the gamma data corresponding to the first display brightness level, and the duty cycle corresponding to the second display brightness level, or according to the duty cycle and the gamma data corresponding to the first display brightness level, and the gamma data corresponding to the second display brightness level, maximum brightness corresponding to an inserted display brightness level and a duty cycle corresponding to the inserted display brightness level are determined.

Whether a binding-point grayscale at the inserted display brightness level is greater than a preset grayscale threshold is determined, and in response to a determination result that the binding-point grayscale at the inserted display brightness level is greater than the preset grayscale threshold, a gamma register value corresponding to the binding-point grayscale at the inserted display brightness level is calculated according to a preset calculation formula.

The preset grayscale threshold is determined by a difference value distribution between an actual gamma register value obtained by actually performing gamma debugging with a preset number of display modules at the inserted display brightness level and a calculated gamma register value calculated according to an initial linear calculation formula, and the preset calculation formula is performed as a formula obtained by correcting the initial linear formula according to the difference value distribution.

The initial linear formula satisfies the following condition: for a determined binding-point grayscale at the inserted display brightness level, the calculated gamma register value obtained according to the initial linear formula is between a gamma register value corresponding to the determined binding-point grayscale at the minimum display brightness level and a gamma register value corresponding to the determined binding-point grayscale at the maximum display brightness level.

In a second aspect, the embodiments of the present application further provide a gamma debugging apparatus which includes an acquisition module, a determination module and a calculation module.

The acquisition module is configured to acquire a duty cycle and gamma data at a first display brightness level and a duty cycle and gamma data at a second display brightness level in a PWM dimming interval. The first display brightness level is a maximum display brightness level in the PWM dimming interval, and the second display brightness level is a minimum display brightness level in the PWM dimming interval, or the first display brightness level is a minimum display brightness level in the PWM dimming interval, and the second display brightness level is a maximum display brightness level in the PWM dimming interval.

The determination module is configured to determine maximum brightness corresponding to an inserted display brightness level and a duty cycle corresponding to the inserted display brightness level according to the duty cycle and the gamma data corresponding to the first display brightness level, and the duty cycle corresponding to the second display brightness level, or according to the duty cycle and the gamma data corresponding to the first display brightness level, and the gamma data corresponding to the second display brightness level.

The calculation module is configured to determine whether a binding-point grayscale at the inserted display brightness level is greater than a preset grayscale threshold, and in response to a determination result that the binding-point grayscale at the inserted display brightness level is greater than the preset grayscale threshold, calculate, according to a preset calculation formula, a gamma register value corresponding to the binding-point grayscale at the inserted display brightness level.

The preset grayscale threshold is determined by a difference value distribution between a gamma register value obtained by actually performing gamma debugging with a preset number of display modules at the inserted display brightness level and a gamma register value calculated according to an initial linear calculation formula, and the preset calculation formula is performed as a formula obtained by correcting the initial linear formula according to the difference value distribution.

The initial linear formula satisfies the following condition: for a determined binding-point grayscale at the inserted display brightness level, the gamma register value obtained according to the initial linear formula is between a gamma register value corresponding to the determined binding-point grayscale at the minimum display brightness level and a gamma register value corresponding to the determined binding-point grayscale at the maximum display brightness level.

The gamma debugging method and apparatus provided by the present embodiments include: according to the duty cycle and the gamma data corresponding to the first display brightness level, and the duty cycle corresponding to the second display brightness level, or according to the duty cycle and the gamma data corresponding to the first display brightness level, and the gamma data corresponding to the second display brightness level, determining the maximum brightness corresponding to the inserted display brightness level and the duty cycle corresponding to the inserted display brightness level, such that the duty cycle corresponding to the inserted display brightness level is determined without a need for debugging, thereby being conducive to saving time for adjustment; and determining whether the binding-point grayscale at the inserted display brightness level is greater than the preset grayscale threshold, and when the binding-point grayscale at the inserted display brightness level is greater than the preset grayscale threshold, calculating, according to the preset calculation formula, the gamma register value corresponding to the binding-point grayscale at the inserted display brightness level, thereby reducing the number of binding-point grayscales on which gamma debugging needs to be performed at the inserted display brightness level, shortening the time for gamma debugging at the inserted display brightness level, shortening the time for gamma debugging in the entire PWM dimming interval and being conducive to improving the production capacity of the production line.

DETAILED DESCRIPTION

The image quality of a display panel is generally improved by increasing the number of gamma debugging groups. However, the above solution has the case where the long time for gamma debugging in a production line affects a production capacity of the production line. Through research, the inventor finds that a reason for the above situation is that an entire range of display brightness level includes a data voltage dimming interval, a pulse-width modulation (PWM) dimming interval and a hybrid dimming interval. The number of gamma debugging groups in the PWM dimming interval is usually more than two. In a manner that the image quality of the display panel is improved by increasing the number of gamma debugging groups, gamma debugging needs to be performed on the display panel at a plurality of different display brightness levels, so as to obtain a plurality of groups of gamma register values at the plurality of different display brightness levels and further reach an object of increasing the number of gamma debugging groups. Using gamma debugging at one display brightness level as an example, a plurality of binding-point grayscales is set at the one display brightness level. A gamma register value is continuously adjusted, and display brightness is continuously acquired. Until the acquired display brightness reaches target brightness corresponding to one of the plurality of binding-point grayscales, a corresponding gamma register value is determined as a gamma register value corresponding to the one of the plurality of binding-point grayscales when the target brightness is reached. After all the plurality of binding-point grayscales are adjusted and tested, gamma register values corresponding to the plurality of binding-point grayscales respectively are determined as one group of gamma register values at the one display brightness level. As can be seen from the above gamma debugging process of obtaining the one group of gamma register values at the one display brightness level, the gamma debugging process is relatively complex. Gamma debugging is performed at different display brightness levels to obtain the plurality of groups of gamma register values, thereby increasing the number of gamma debugging groups and resulting in a relatively long time for gamma debugging. Moreover, the gamma debugging process is usually completed on the production line so that the time for gamma debugging in the production line becomes longer and affects the production capacity of the production line.

Figure 1:
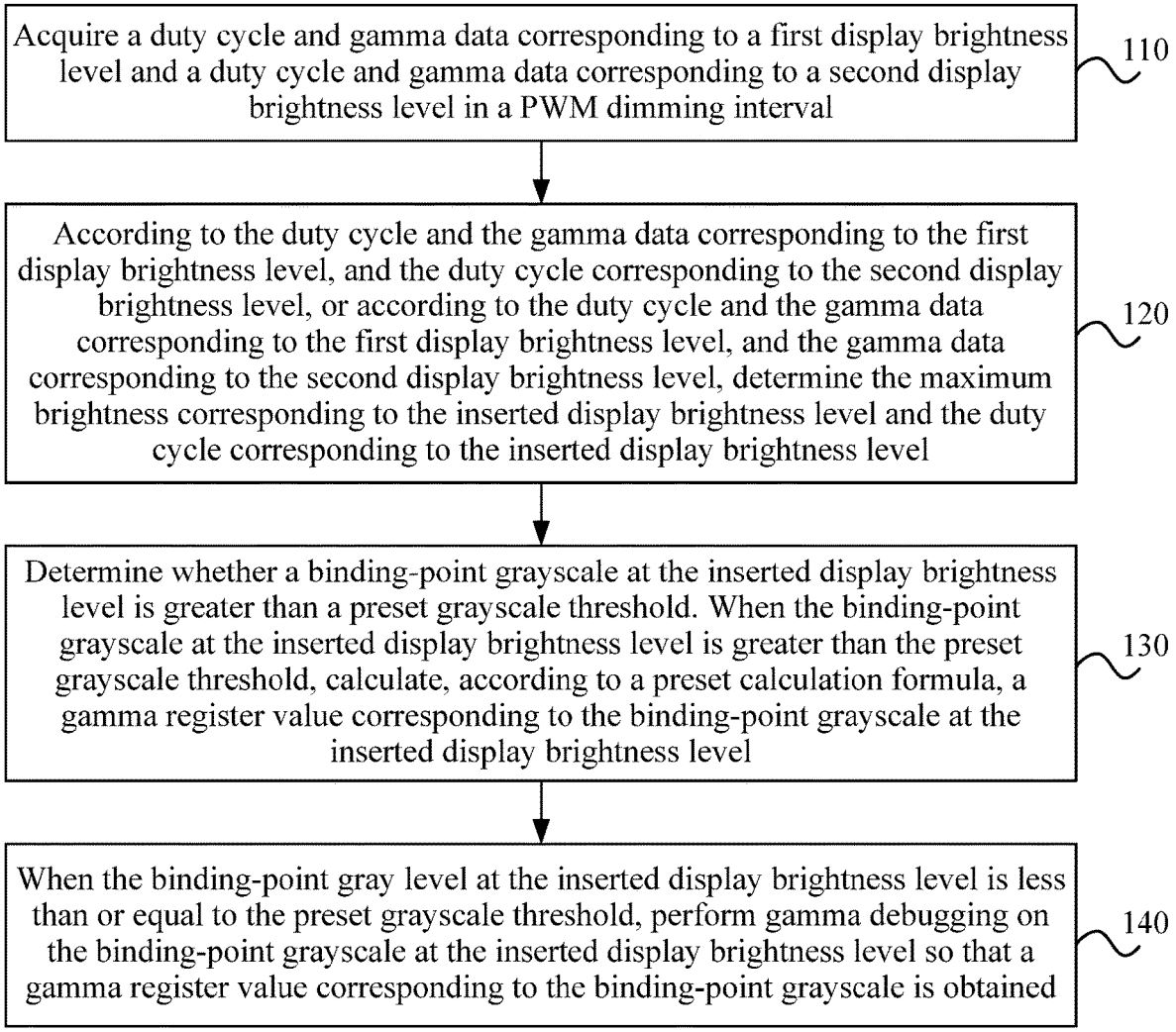
FIG. 1 is a flowchart of gamma calculation debugging according to an embodiment of the present application.

Embodiments of the present application provide a gamma debugging method. FIG. 1 is a flowchart of a gamma debugging method according to an embodiment of the present application. Referring to FIG. 1, the gamma debugging method includes steps 110 to 140.

In step 110, a duty cycle and gamma data corresponding to a first display brightness level and a duty cycle and gamma data corresponding to a second display brightness level in a PWM dimming interval are acquired. The first display brightness level is a maximum display brightness level in the PWM dimming interval, and the second display brightness level is a minimum display brightness level in the PWM dimming interval, or, the first display brightness level is a minimum display brightness level in the PWM dimming interval, and the second display brightness level is a maximum display brightness level in the PWM dimming interval.

Figure 2:
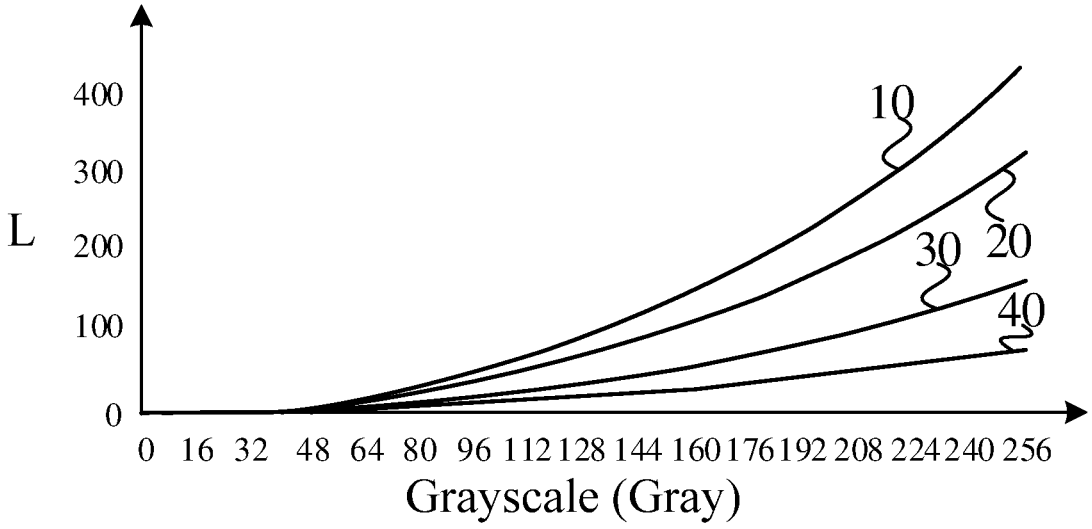
FIG. 2 is a schematic diagram of gamma curves corresponding to different display brightness values (DBVs) according to an embodiment of the present application.

For example, a display device such as a mobile phone or a computer generally includes a brightness adjustment button through which a user changes an input display brightness level. The display brightness level is also referred to as a display brightness value (DBV). Each display brightness level may correspond to respective display brightness of a maximum grayscale in the display panel. Display brightness corresponding to another grayscale changes with the display brightness corresponding to the maximum grayscale in the display panel. When the display brightness corresponding to the maximum grayscale in the display panel increases, the display brightness corresponding to another grayscale also increases. When the display brightness corresponding to the maximum grayscale in the display panel decreases, the display brightness corresponding to another grayscale also decreases. Therefore, it may also be understood as that each display brightness level corresponds to one gamma curve. FIG. 2 is a schematic diagram of gamma curves corresponding to different DBVs according to an embodiment of the present application. Referring to FIG. 2, four gamma curves are illustratively shown in FIG. 2. In FIG. 2, the abscissa "GRAY" represents the grayscale, and the ordinate "L" represents the brightness. Table 1 is a table showing the correspondence between the display brightness level "DBV" and maximum brightness "luminance-max".

TABLE 1

| DBV | Luminance-max |
|---|---|
| DBV_Hbm | L0 |
| DBV_Nor1 | L1 |
| DBV_Nor2 | L2 |
| DBV_Nor3 | L3 |
| DBV_Nor4 | L4 |
| DBV_Nor5 | L5 |
| DBV_Nor6 | L6 |
| DBV_Nor7 | L7 |
| DBV_Nor8 | L8 |
| DBV_Nor9 | L9 |

Referring to Table 1, DBV_Hbm, DBV_Nor1, DBV_Nor2, DBV_Nor3, DBV_Nor4, DBV_Nor5, DBV_Nor6, DBV_Nor7, DBV_Nor8 and DBV_Nor9 represent different display brightness levels, and L0, L1, L2, L3, L4, L5, L6, L7, L8, and L9 represent maximum brightness at DBV_Hbm, DBV_Nor1, DBV_Nor2, DBV_Nor3, DBV_Nor4, DBV_Nor5, DBV_Nor6, DBV_Nor7, DBV_Nor8 and DBV_Nor9, respectively. For example, the display brightness levels from DBV_Hbm to DBV_Nor9 decrease in sequence. Correspondingly, the maximum brightness on the gamma curves corresponding from DBV_Hbm to DBV_Nor9 decreases in sequence. For example, the data voltage dimming section is DBV_Hbm-DBV_Nor4; The PWM dimming section is DBV_Nor5-DBV_Nor8. The gamma curves shown in FIG. 2 include a first gamma curve 10, a second gamma curve 20, a third gamma curve 30 and a fourth gamma curve 40, where the first gamma curve 10 may correspond to a gamma curve at DBV_Nor5, the second gamma curve 20 may correspond to a gamma curve at DBV_Nor6, the third gamma curve 30 may correspond to a gamma curve at DBV_Nor7, and the fourth gamma curve 40 may correspond to a gamma curve at DBV_Nor8. For example, when the first display brightness level is the maximum display brightness level in the PWM dimming interval and the second display brightness level is the minimum display brightness level in the PWM dimming interval, the first display brightness level is DBV_Nor5, and the second display brightness level is DBV_Nor8. DBV_Nor6 and DBV_Nor7 may be respectively considered as an inserted display brightness level. Maximum brightness corresponding to the inserted display brightness level and a duty cycle corresponding to the inserted display brightness level are determined according to step 120 described below.

Figure 3:
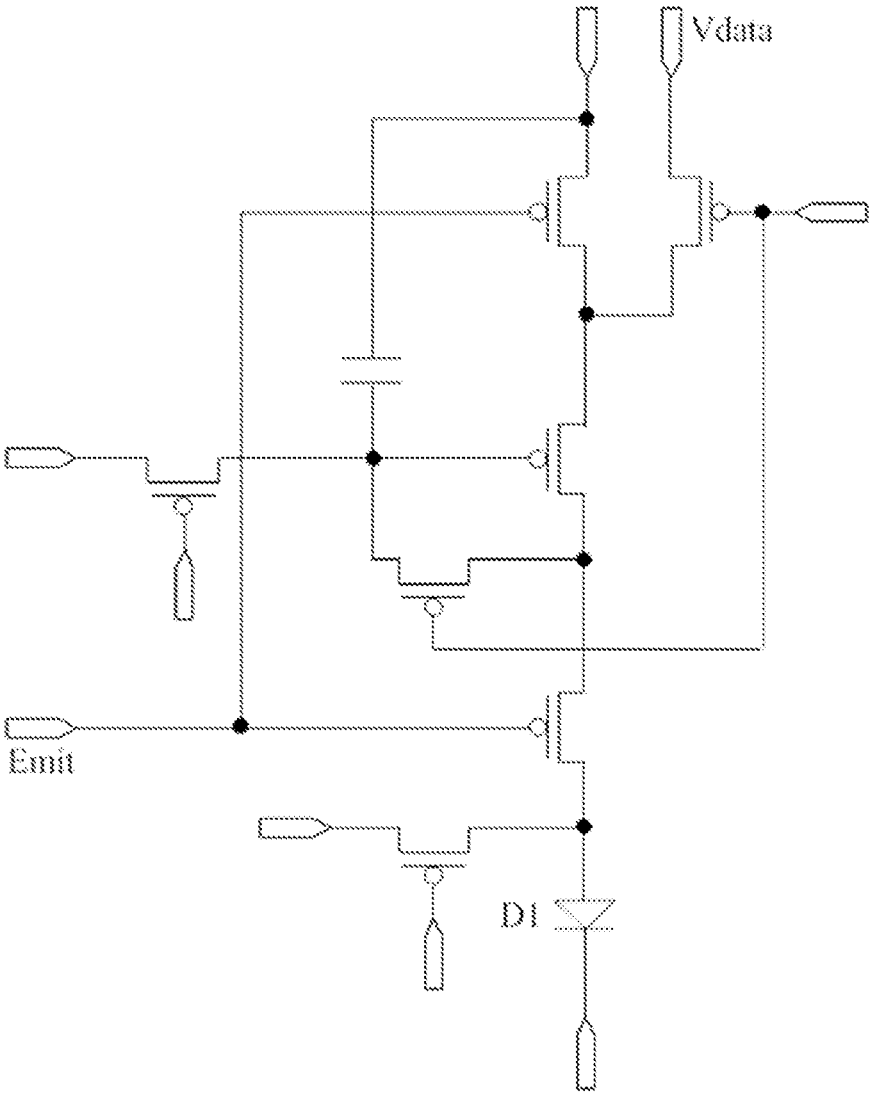
FIG. 3 is a structure diagram of a commonly used 7T1C pixel circuit.

For example, at least one PWM dimming interval generally exists between the minimum value of the display brightness level and the maximum value of the display brightness level. The PWM dimming interval is a display brightness level interval which adjusts the display brightness at least by adjusting a low-level pulse-width duty cycle (or a high-level pulse-width duty cycle) of a light emission control signal in a pixel circuit. In an embodiment, in the present embodiment, the PWM dimming interval is the display brightness level interval which adjusts the display brightness by adjusting the low-level pulse-width duty cycle (or the high-level pulse-width duty cycle) of the light emission control signal in the pixel circuit and a data voltage supplied to the pixel circuit. That is, the duty cycle in the embodiments of the present application may refer to the low-level pulse-width duty cycle of the light emission control signal in the pixel circuit or the high-level pulse-width duty cycle of the light emission control signal in the pixel circuit. FIG. 3 is a structure diagram of a commonly used 7T1C pixel circuit, where a light emission control signal is inputted to a light emission control signal input terminal Emit, and a low-level pulse-width duty cycle (or a high-level pulse-width duty cycle) of the light emission control signal is used for controlling a light emission duration of a light-emitting device within one frame; and a data voltage is inputted to a data voltage input terminal Vdata, and a magnitude of the data voltage is used for controlling a drive current flowing through the light-emitting device D1. The display panel is generally driven by a driver chip, that is, the driver chip supplies the data voltage to the display panel, and the data voltage exists in the form of a gamma register value in the drive chip. Therefore, in the present embodiment, the PWM dimming interval is a display brightness level interval which adjusts the display brightness by adjusting the low-level pulse-width duty cycle (or the high-level pulse-width duty cycle) of the light emission control signal in the pixel circuit and the gamma register value.

In an embodiment, a duty cycle and gamma data corresponding to the maximum display brightness level may be obtained by performing gamma debugging in advance at the maximum display brightness level in the PWM dimming interval, and a duty cycle and gamma data corresponding to the minimum display brightness level may be obtained by performing gamma debugging in advance at the minimum display brightness level in the PWM dimming interval. The gamma data may include brightness corresponding to a binding-point grayscale and a gamma register value corresponding to the binding-point grayscale. In the present embodiment and the following embodiments, the maximum display brightness level refers to the maximum display brightness level in the PWM dimming interval, and the minimum display brightness level refers to the minimum display brightness level in the PWM dimming interval. The binding-point grayscale includes the maximum grayscale, for example, the binding-point grayscale includes a 255 grayscale when a display grayscale has a range of 0-255 grayscale.

In step 120, according to the duty cycle and the gamma data corresponding to the first display brightness level, and the duty cycle corresponding to the second display brightness level, or according to the duty cycle and the gamma data corresponding to the first display brightness level, and the gamma data corresponding to the second display brightness level, the maximum brightness corresponding to the inserted display brightness level and the duty cycle corresponding to the inserted display brightness level are determined.

In an embodiment, the PWM dimming interval includes a first level binding point to an m-th level binding point in sequence in a descending order of a display brightness level. The maximum display brightness level is the first level binding point, the minimum display brightness level is the m-th level binding point, and the inserted display brightness level includes a second level binding point to an (m−1)-th level binding point, where m≥3. The inserted display brightness level is between the maximum display brightness level and the minimum display brightness level.

In an embodiment, the first display brightness level is the maximum display brightness level in the PWM dimming interval, and the second display brightness level is the minimum display brightness level in the PWM dimming interval.

In an embodiment, step 120 may include a step described below.

In step 121, according to a duty cycle and maximum brightness corresponding to the maximum display brightness level, and maximum brightness corresponding to the minimum display brightness level, determining the maximum brightness corresponding to the inserted display brightness level and the corresponding duty cycle; the maximum brightness corresponding to the inserted display brightness level is calculated according to the following formula:

$$L_q = \frac{L_1}{\lambda^{(q-1)}}, \text{ where } \lambda = \sqrt[(m-1)]{L_1 / L_m}.$$

$L_q$ denotes maximum brightness corresponding to a q-th level binding point, q denotes an ordinal number of the brightness level and $2 \le q \le (m-1)$, $L_1$ denotes the maximum brightness corresponding to the maximum display brightness level, $L_m$ denotes the maximum brightness corresponding to the minimum display brightness level, and m denotes a total brightness level.

For example, the maximum brightness corresponding to the maximum display brightness level is brightness corresponding to a maximum display grayscale at the maximum display brightness level, and the maximum brightness corresponding to the minimum display brightness level is brightness corresponding to a minimum display grayscale at the minimum display brightness level. In the PWM dimming interval, the maximum brightness corresponding to the maximum display brightness level and the maximum brightness corresponding to the minimum display brightness level are known.

The duty cycle corresponding to the inserted display brightness level is calculated according to the following formula:

$$EM_q = \frac{EM_1}{\lambda^{(q-1)}}.$$

$EM_q$ denotes a duty cycle corresponding to the q-th level binding point and $2 \le q \le (m-1)$, and $EM_1$ denotes the duty cycle corresponding to the maximum display brightness level.

In an embodiment, step 120 may include a step 122 described below.

In step 122, according to a duty cycle and maximum brightness corresponding to the maximum display brightness level, and a duty cycle corresponding to the minimum display brightness level, determining the maximum brightness corresponding to the inserted display brightness level and the corresponding duty cycle; the maximum brightness corresponding to the inserted display brightness level is calculated according to the following formula:

$$L_q = \frac{L_1}{\lambda^{(q-1)}}, \text{ where } \lambda = \sqrt[(m-1)]{EM_1 / EM_m}.$$

$L_q$ denotes maximum brightness corresponding to a q-th level binding point and $2 \le q \le (m-1)$, $L_1$ denotes the maximum brightness corresponding to the maximum display brightness level, $EM_1$ denotes the duty cycle corresponding to the maximum display brightness level and denotes the duty cycle corresponding to the minimum display brightness level.

The duty cycle corresponding to the inserted display brightness level is calculated according to the following formula:

$$EM_q = \frac{EM_1}{\lambda^{(q-1)}}.$$

$EM_q$ denotes a duty cycle corresponding to the q-th level binding point.

In an embodiment, the first display brightness level is the minimum display brightness level in the PWM dimming interval, and the second display brightness level is the maximum display brightness level in the PWM dimming interval.

In an embodiment, step 120 may include a step 123 described below.

In step 123, according to a duty cycle and maximum brightness corresponding to the minimum display brightness level, and maximum brightness corresponding to the maximum display brightness level, determining the maximum brightness corresponding to the inserted display brightness level and the corresponding duty cycle; the maximum brightness corresponding to the inserted display brightness level is calculated according to the following formula:

$$L_q = L_m * \lambda^{(m-q)}, \text{ where } \lambda = \sqrt[(m-1)]{L_1 / L_m}.$$

$L_q$ denotes maximum brightness corresponding to a q-th level binding point, q denotes an ordinal number of the brightness level and $2 \le q \le (m-1)$, $L_1$ denotes the maximum brightness corresponding to the maximum display brightness level, denotes the maximum brightness corresponding to the minimum display brightness level, and m denotes a total brightness level;

The duty cycle corresponding to the inserted display brightness level is calculated according to the following formula:

$$EM_q = EM_m * \lambda^{(m-q)}$$

$EM_q$ denotes a duty cycle corresponding to the q-th level binding point, and $EM_m$ denotes the duty cycle corresponding to the minimum display brightness level.

In an embodiment, step 120 may include a step 124 described below.

In step 124, according to a duty cycle and maximum brightness corresponding to the minimum display brightness level, and a duty cycle corresponding to the maximum display brightness level, determining the maximum brightness corresponding to the inserted display brightness level and the corresponding duty cycle; the maximum brightness corresponding to the inserted display brightness level is calculated according to the following formula:

$$L_q = L_m * \lambda^{(m-q)}, \text{ where } \lambda = \sqrt[(m-1)]{EM_1 / EM_m}.$$

$L_q$ denotes maximum brightness corresponding to a q-th level binding point and $2 \le q \le (m-1)$, $L_m$ denotes the maximum brightness corresponding to the minimum display brightness level, $EM_1$ denotes the duty cycle corresponding to the maximum display brightness level, and $EM_m$ denotes the duty cycle corresponding to the minimum display brightness level.

The duty cycle corresponding to the inserted display brightness level is calculated according to the following formula:

$$EM_q = EM_m * \lambda^{(m-q)}$$

$EM_q$ denotes a duty cycle corresponding to the q-th level binding point, and $EM_m$ denotes the duty cycle corresponding to the minimum display brightness level. In the present embodiment, step 121, step 122, step 123 and step 124 are four juxtaposed implementations of step 120, that is, the maximum brightness corresponding to the inserted display brightness level and the corresponding duty cycle may be determined by step 121, step 122, step 123 or step 124. That is, in the present embodiment, the inserted display brightness level (the display brightness levels are in one-to-one correspondence with maximum brightness, and after the maximum brightness is determined, the inserted display brightness level is determined) and the corresponding duty cycle may be determined according to the duty cycle and the maximum brightness corresponding to the first display brightness level and the maximum brightness corresponding to the second display brightness level, or according to the duty cycle and the maximum brightness corresponding to the first display brightness level and the duty cycle corresponding to the second display brightness level, so, the duty cycle corresponding to the inserted display brightness level is determined without a need for debugging, thereby being conducive to save time for the debugging.

In step 130, judging whether a binding-point grayscale at the inserted display brightness level is greater than a preset grayscale threshold. When the binding-point grayscale at the inserted display brightness level is greater than the preset grayscale threshold, calculating a gamma register value corresponding to the binding-point grayscale at the inserted display brightness level according to a preset calculation formula.

The preset grayscale threshold is determined by a difference value distribution between a gamma register value obtained by actually performing gamma debugging with a preset number of display modules at the inserted display brightness level and a gamma register value calculated according to an initial linear calculation formula. The preset calculation formula is performed as a formula obtained by correcting the initial linear formula according to the difference value distribution. The initial linear formula satisfies the following condition: for any binding-point grayscale, for example, a determined binding-point grayscale, at the inserted display brightness level, the gamma register value obtained according to the initial linear formula is between a gamma register value corresponding to the determined binding-point grayscale at the minimum display brightness level and a gamma register value corresponding to the determined binding-point grayscale at the maximum display brightness level.

For example, the preset grayscale threshold may be determined according to a maximum difference value among difference values between actual gamma register values obtained by actually performing gamma debugging with a plurality of display modules at the inserted display brightness level and calculated gamma register values calculated according to the initial linear calculation formula (in some positions of the present embodiment and the following embodiments, the difference value between the gamma register value actually subjected to gamma debugging at the inserted display brightness level and the gamma register value calculated according to the initial linear calculation formula is expressed as the difference value). In an embodiment, at the same inserted display brightness level, the preset grayscale threshold satisfies the following conditions: when the binding-point grayscale is less than the preset grayscale threshold, a maximum difference value among difference values corresponding to a plurality of display modules at the same binding-point grayscale is greater than a first difference value threshold; and when the binding-point grayscale is greater than the preset grayscale threshold, the maximum difference value among the difference values corresponding to the plurality of display modules is less than the first difference value threshold. In an embodiment, the first difference value threshold may be set by those skilled in the art based on actual experience.

When the binding-point grayscale is relatively large, the corresponding display brightness is relatively high. Through research, when the binding-point grayscale is greater than the preset grayscale threshold, a relationship between the gamma register value and the binding-point grayscale may satisfy the preset calculation formula. Therefore, in this step, when the binding-point grayscale at the inserted display brightness level is greater than the preset grayscale threshold, the gamma register value corresponding to the binding-point grayscale is calculated according to the preset calculation formula, so as to reduce the number of binding-point grayscales on which gamma debugging needs to be performed at the inserted display brightness level. Therefore, the time for gamma debugging at the inserted display brightness level has been shorten and the time for gamma debugging in the entire PWM dimming interval has been shorten too. The preset calculation formula is obtained by correcting the initial linear formula according to the difference value distribution, and the difference value distribution is the difference value distribution between the gamma register value obtained by actually performing gamma debugging with the preset number of display modules at the inserted display brightness level and the gamma register value calculated according to the initial linear calculation formula. The initial linear calculation formula may be set artificially. In an embodiment, for a gamma register value corresponding to any binding-point grayscale, for example, a determined binding-point grayscale, greater than the preset grayscale threshold at the inserted display brightness level, the initial linear calculation formula may be a linear calculation formula for the gamma register value corresponding to the determined binding-point grayscale at the maximum display brightness level and the gamma register value corresponding to the determined binding-point grayscale at the minimum display brightness level and satisfy the conditions in the above step 130. Since the initial linear calculation formula is expressed as set artificially, the preset calculation formula is expressed as set as the formula obtained by correcting the initial linear formula according to the difference value distribution, thereby ensuring the accuracy of calculating the gamma register value by the preset calculation formula.

In an embodiment, the greater the inserted display brightness level is, the less the preset grayscale threshold corresponding to the inserted display brightness level is. Through research, when the brightness is relatively high, the correspondence between the gamma register value and the binding-point grayscale satisfies the preset calculation formula. The greater the inserted display brightness level is, the greater the maximum brightness corresponding to the inserted display brightness level is, so that brightness corresponding to each grayscale is relatively high. Therefore, when the inserted display brightness level is relatively high, a relatively small grayscale may have relatively high brightness, that is, the greater the inserted display brightness level is, the less the preset grayscale threshold corresponding to the inserted display brightness level is.

In an embodiment, the gamma debugging method provided by the present embodiment further includes a step 140 described below.

In step 140, when the binding-point gray level at the inserted display brightness level is less than or equal to the preset grayscale threshold, gamma debugging is performed on the binding-point grayscale at the inserted display brightness level so that a gamma register value corresponding to the binding-point grayscale is obtained.

For example, when the binding-point grayscale at the inserted display brightness level is less than or equal to the preset grayscale threshold, the preset calculation formula cannot be applied. Therefore, the gamma register value corresponding to the binding-point grayscale can be obtained by actually performing gamma debugging.

The gamma debugging method provided by the present embodiment includes: according to the duty cycle and the gamma data corresponding to the first display brightness level, and the duty cycle corresponding to the second display brightness level, or according to the duty cycle and the gamma data corresponding to the first display brightness level, and the gamma data corresponding to the second display brightness level, determining the maximum brightness corresponding to the inserted display brightness level and the duty cycle corresponding to the inserted display brightness level, such that the duty cycle corresponding to the inserted display brightness level is determined without a need for debugging, thereby to save time for adjustment; and determining whether the binding-point grayscale at the inserted display brightness level is greater than the preset grayscale threshold, and when the binding-point grayscale at the inserted display brightness level is greater than the preset grayscale threshold, calculating, according to the preset calculation formula, the gamma register value corresponding to the binding-point grayscale at the inserted display brightness level, thereby reducing the number of binding-point grayscales on which gamma debugging needs to be performed at the inserted display brightness level. Therefore, the time for gamma debugging at the inserted display brightness level is shortened, the time for gamma debugging in the entire PWM dimming interval is shorted, and the production capacity of the production line has been improved.

Based on the preceding embodiment, the initial linear calculation formula is satisfied as:

$$V_{qk}=((q-1)*(V_{mk}+(m-q)*V_{1k})/(m-1)$$

In the initial linear calculation formula, $V_{qk}$ denotes a gamma register value corresponding to a k-th binding-point grayscale at the q-th level binding point, $V_{1k}$ denotes a gamma register value corresponding to a k-th binding point grayscale at the first level binding point, $V_{mk}$ denotes a gamma register value corresponding to a k-th binding-point grayscale at the m-th level binding point and $1 \leq k \leq p$, where p denotes a total number of binding-point grayscales at the inserted display brightness level.

For example, in the present embodiment, the initial linear calculation formula is satisfied as $V_{qk}=((q-1)*V_{mk}+(m-q)*V_{1k})/(m-1)$, which can ensure that a gamma register value corresponding to a determined binding-point grayscale can be calculated according to the gamma register value corresponding to the determined binding-point grayscale at the maximum display brightness level and the gamma register value corresponding to the determined binding-point grayscale at the minimum display brightness level. At a determined binding-point grayscale greater than the preset grayscale threshold, the gamma register value at the inserted display brightness level calculated according to the initial linear calculation formula is between the gamma register value corresponding to the determined binding-point grayscale at the maximum display brightness level and the gamma register value corresponding to the determined binding-point grayscale at the minimum display brightness level.

In an embodiment, the preset calculation formula is satisfied as:

$$V'_{qk} = \frac{((q-1)*V_{mk}+(m-q)*V_{1k})}{(m-1)} + aGray[k] + b.$$

In the preset calculation formula, $V'_{qk}$ denotes a gamma register value corresponding to the k-th binding-point grayscale at the q-th level binding point, a and b are determined by the difference value distribution between the gamma register value obtained by actually performing gamma debugging with the preset number of display modules at the inserted display brightness level and the gamma register value calculated according to the initial linear calculation formula, and Gray[k] denotes a k-th binding-point grayscale at the inserted display brightness level.

A process of determining a and b includes steps described below.

According to the difference value between the gamma register value obtained by actually performing gamma debugging with the display modules at the inserted display brightness level and the gamma register value calculated according to the initial linear calculation formula, a curve showing a relationship between the binding-point grayscale and the difference value is plotted.

According to slopes of curves showing relationships between binding-point grayscales corresponding to a plurality of display modules and difference values and a maximum value among difference values corresponding to the plurality of display modules at the same binding-point grayscale, a and b are determined.

In an embodiment, according to the slopes of the curves showing the relationships between the binding-point grayscales corresponding to the plurality of display modules and the difference values and the maximum value among the difference values corresponding to the plurality of display modules at the same binding-point grayscale, a and b are determined, which includes cases described below.

When the binding-point grayscale is between the preset grayscale threshold and a first binding-point grayscale, $a=(R_1-R_{th})/(Gray[k_1]-Gray[k_{th}])$ and $b=-(R_1-R_{th})*Gray[k_{th}]/(Gray[k_1]-Gray[k_{th}])+R_{th}$.

$R_1$ denotes an average value of difference values corresponding to the plurality of display modules at the first binding-point grayscale at the inserted display brightness level, $R_{th}$ denotes an average value of difference values corresponding to the plurality of display modules at the preset grayscale threshold at the inserted display brightness level, Gray[$k_1$] denotes the first binding-point grayscale, and denotes the preset grayscale threshold, where $k_1>k_{th}$, $1\leq k_1\leq p$ and $1\leq k_{th}\leq p$.

When the binding-point grayscale is between the preset grayscale threshold and the first binding-point grayscale, curves showing the relationship between the binding-point grayscale and the difference value, which are between any two adjacent binding-point grayscales, have slopes which have the same sign, that is, the slopes of any two adjacent binding-point grayscales are positive, or, the slopes of any two adjacent binding-point grayscales are negative.

When the binding-point grayscale is less than the preset grayscale threshold, the maximum value among the difference values corresponding to the plurality of display modules at the same binding-point grayscale is greater than a first difference value threshold; and when the binding-point grayscale is greater than the preset grayscale threshold, the maximum value among the difference values corresponding to the plurality of display modules is less than the first difference value threshold.

Figure 4:
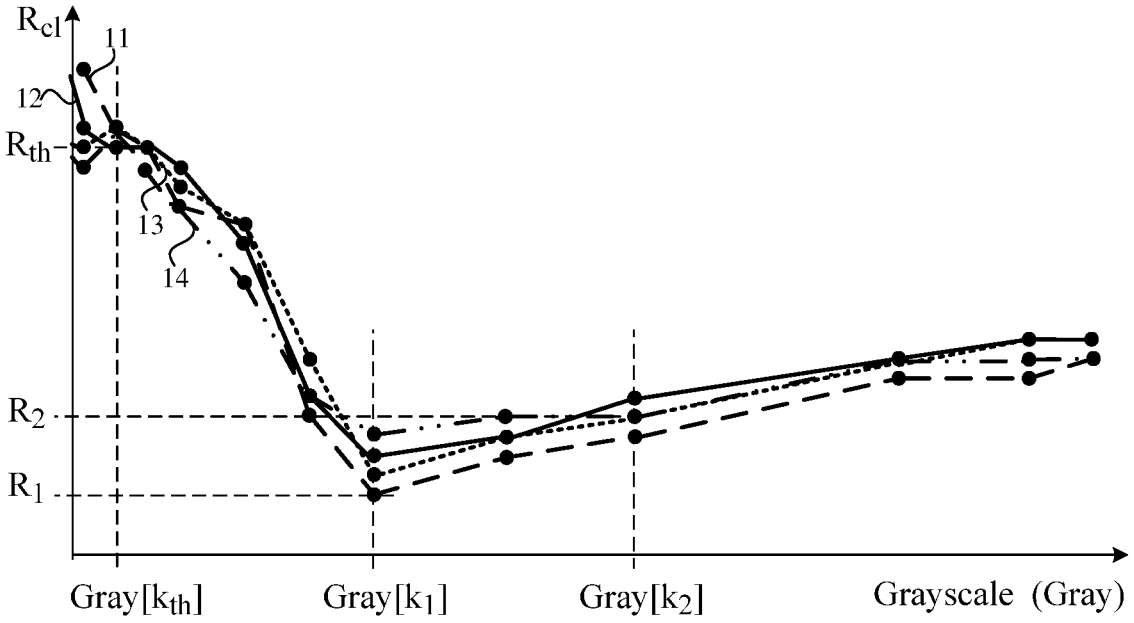
FIG. 4 is a schematic diagram of curves showing relationships between binding-point grayscales and difference values corresponding to display modules according to an embodiment of the present application.

FIG. 4 is a schematic diagram of curves showing relationships between binding-point grayscales and difference values corresponding to display modules according to an embodiment of the present application, where the abscissa "Gray" represents the grayscale, and the ordinate "Rcl" represents the difference value between the gamma register value obtained by actually performing gamma debugging with the display modules at the inserted display brightness level and the gamma register value calculated according to the initial linear calculation formula. Referring to FIG. 4, FIG. 4 illustratively shows curves showing relationships between binding-point grayscales and difference values corresponding to four display modules at the same inserted display brightness level, which are a curve 11, a curve 12, a curve 13 and a curve 14, respectively, and an example in which the preset number of display modules are four is described. Referring to FIG. 4, when the binding-point grayscale is relatively small and less than the preset grayscale threshold Gray[$k_{th}$], the difference value between the gamma register value obtained by actually performing gamma debugging with the display modules at the inserted display brightness level and the gamma register value calculated according to the initial linear calculation formula is expressed as discretely distributed. At the same binding-point grayscale, a maximum difference value (a maximum difference value) among the difference values corresponding to the plurality of display modules is relatively large, and at this time, the curves corresponding to the plurality of display modules are relatively chaotic and irregular. Therefore, when the binding-point grayscale is less than the preset grayscale threshold Gray[$k_{th}$], the difference value cannot be represented by a uniform calculation formula. When the binding-point grayscale is greater than the preset grayscale threshold Gray[$k_{th}$], for example, when the binding-point grayscale is between the preset grayscale threshold Gray[$k_{th}$] and the first binding-point grayscale Gray[$k_1$], the maximum value among the difference values is relatively small on the curves showing the relationship between the binding-points corresponding to the plurality of display modules at any binding-point grayscale, and lines connecting any two adjacent binding points on the same relationship curve have slopes which have the same sign, and two same and adjacent binding points on different relationship curves have the same slope. Therefore, the curve showing the relationship between the preset grayscale threshold Gray[$k_{th}$] and the first binding-point grayscale Gray[$k_1$] may be approximately regarded as a straight line for any display panel. A coordinate point formed by the preset grayscale threshold Gray[$k_{th}$] and the corresponding difference value and a coordinate point formed by the first binding-point grayscale Gray[$k_1$] and the corresponding difference value are two endpoints of the straight line, respectively. Since the preset number of display modules is plural, and the curves showing the relationships between the binding-point grayscale and the difference value are in a one-to-one correspondence with the display modules, the relationship curves are also plural, and different relationship curves may have different difference values corresponding to the same binding-point grayscale. Therefore, in the present embodiment, a coordinate point corresponding to the preset grayscale threshold Gray[$k_{th}$] and the average value of the difference values corresponding to the plurality of display modules at the preset grayscale threshold Gray[$k_{th}$] is taken as one point on the straight line, and a coordinate point corresponding to the first binding-point grayscale Gray[$k_1$] and the average value of the difference values corresponding to the plurality of display modules at the first binding-point grayscale Gray[$k_1$] is taken as the other point on the straight line, so that a function corresponding to the straight line can be obtained. When the binding-point grayscale is between the preset grayscale threshold and the first binding-point grayscale, it may be considered that the difference value corresponding to the binding-point grayscale is also on the straight line. Therefore, the difference value corresponding to the binding-point grayscale can be obtained by the function corresponding to the straight line and the binding-point grayscale.

The Calculation Procedure is:

$(R_k-R_{th})/(\text{Gray}[k]-\text{Gray}[k_{th}])=(R_1-R_{th})/(\text{Gray}[k_1]-\text{Gray}[K_{th}])$, and then $R_k=(R_1-R_{th})/(\text{Gray}[k_1]-\text{Gray}[k_{th}])*\text{Gray}[k]-(R_1-R_{th})*\text{Gray}[k_{th}]/(\text{Gray}[k_1]-\text{Gray}[k_{th}])+R_{th}$ can be obtained.

$R_k$ denotes the difference value corresponding to any binding-point grayscale Gray[k] between the preset grayscale threshold and the first binding-point grayscale. The formula is satisfied as corresponded to the preset calculation formula, $a=(R_1-R_{th})/(\text{Gray}[k_1]-\text{Gray}[k_{th}])$ and $b=-(R_1-R_{th})*\text{Gray}[k_{th}]/(\text{Gray}[k_1]-\text{Gray}[k_{th}])+R_{th}$ can be obtained.

In an embodiment, when the binding-point grayscale is between the first binding-point grayscale and the second binding-point grayscale, $a=(R_2-R_1)/(\text{Gray}[k_2]-\text{gray}[k_1])$ and $b=-(R_2-R_1)*\text{Gray}[k_1]/(\text{Gray}[k_2]-\text{Gray}[k_1])+R_1$ can be obtained.

$R_2$ denotes an average value of difference values corresponding to the plurality of display modules at the second binding-point gray level at the inserted display brightness level, and Gray[$k_2$] denotes the second binding-point grayscale, where $1\leq k_2\leq p$ and $k_2>k_1$.

When the binding-point grayscale is between the first binding-point grayscale and the second binding-point grayscale, curves showing the relationship between the binding-point grayscale and the difference value, which are between any two adjacent binding-point grayscales, have slopes which have the same sign.

The curve showing the relationship between the preset grayscale threshold and the first binding-point grayscale, and the curve showing the relationship between the binding-point grayscale between the first binding-point grayscale and the second binding-point grayscale and the difference value have slopes which have opposite signs, that is, one slope is positive and the other is negative.

For example, when the binding-point grayscale is greater than the preset grayscale threshold Gray[$k_{th}$] for example, when the binding-point grayscale is between the first binding-point grayscale Gray[$k_1$] and the second binding-point grayscale Gray[$k_2$], the maximum value among the difference values is relatively small on the curves showing the relationship between the binding-points grayscale corresponding to the binding-points of the plurality of display modules and the difference values, at any binding-point grayscale. Lines connecting any two adjacent binding points on the same relationship curve have slopes which have the same sign, and two same and adjacent binding points on different relationship curves have the same slope.

Therefore, the curve showing the relationship between the first binding-point grayscale Gray[$k_1$] and the second binding-point grayscale Gray[$k_2$] may be approximately regarded as a straight line for any display module. A coordinate point formed by the first binding-point grayscale Gray[$k_1$] and the corresponding difference value and a coordinate point formed by the second binding-point grayscale Gray[$k_2$] and the corresponding difference value are two endpoints of the straight line, respectively. Since the preset number of display modules is plural, and the curves showing the relationships between the binding-point grayscale and the difference value are in a one-to-one correspondence with the display modules, the relationship curves are also plural, and different relationship curves may have different difference values corresponding to the same binding-point grayscale. Therefore, in the present embodiment, a coordinate point corresponding to the first binding-point grayscale Gray[$k_1$] and the average value of the difference values corresponding to the plurality of display modules at the first binding-point grayscale Gray[$k_1$] is taken as one point on the straight line, and a coordinate point corresponding to the second binding-point grayscale Gray[$k_2$] and the average value of the difference values corresponding to the plurality of display modules at the second binding-point grayscale Gray[$k_2$] is taken as the other point on the straight line, so that a function corresponding to the straight line can be obtained. When the binding-point grayscale is between the first binding-point grayscale and the second binding-point grayscale, it may be considered that the difference value corresponding to the binding-point grayscale is also on the straight line. Therefore, the difference value corresponding to the binding-point grayscale can be obtained by the function corresponding to the straight line and the binding-point grayscale.

The calculation process is similar to that when the binding-point grayscale is between the preset grayscale threshold and the first binding-point grayscale, and details are not repeated here. Finally, calculation formulas corresponding to a and b respectively can be obtained.

In an embodiment, when the binding-point grayscale is between the second binding-point grayscale and a maximum grayscale, a=0 and b=0.

When the binding-point grayscale is between the second binding-point grayscale and the maximum grayscale, at any binding-point grayscale, an absolute value of a difference value corresponding to the plurality of display modules is less than an absolute value of a preset difference value, wherein the absolute value of the preset difference value is less than an absolute value of the first difference value, and the first difference value is a difference value corresponding to a binding-point grayscale between the preset grayscale threshold and the second binding-point grayscale on a curve showing a relationship between the binding-point grayscale between the preset grayscale threshold and the second binding-point grayscale and the difference value.

When the binding-point grayscale is between the second binding-point grayscale and the maximum grayscale, the absolute value of the difference value corresponding to each of the plurality of display panels is less than the absolute value of the preset difference value. In an embodiment, the absolute value of the preset difference value is close to 0, for example, the absolute value of the preset difference value is equal to 3. That is, when the binding-point grayscale is between the second binding-point grayscale and the maximum grayscale, the difference value corresponding to each of the plurality of display modules is relatively small, and it may be considered that the difference value is approximately 0. In this case, the gamma register value corresponding to the binding-point grayscale is calculated according to the initial linear calculation formula, that is, a=0 and b=0.

It is to be noted that the preset number being only four is used as an example for illustrative description, and an actual preset number may be a relatively large number, for example, far larger than four (may be 100 and 200), which is not limited in the present embodiment.

Figure 5:
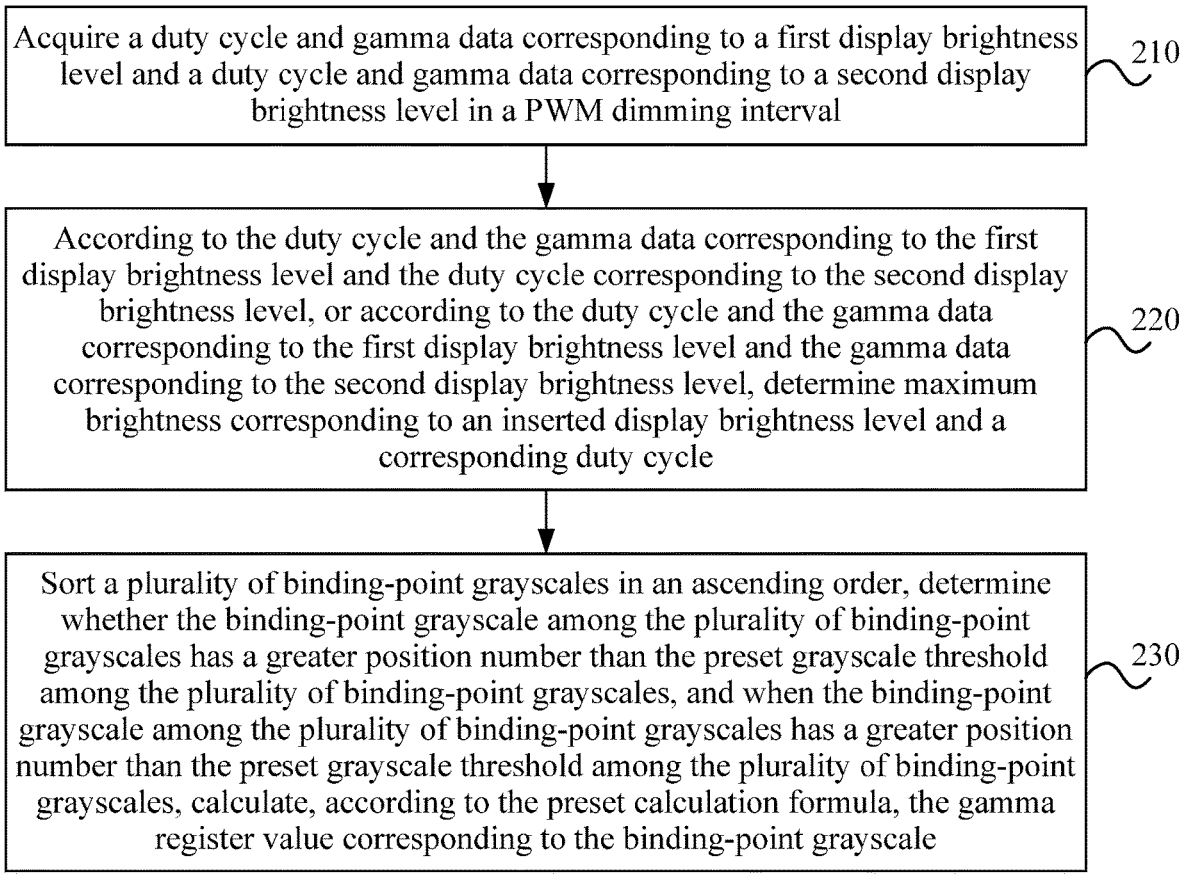
FIG. 5 is a flowchart of another gamma debugging method according to an embodiment of the present application.

FIG. 5 is a flowchart of another gamma debugging method according to an embodiment of the present application. Referring to FIG. 5, the gamma debugging method includes steps 210 to 230.

In step 210, a duty cycle and gamma data corresponding to a first display brightness level and a duty cycle and gamma data corresponding to a second display brightness level in a PWM dimming interval are acquired. This step is the same as step 110 described in the preceding embodiment and is not repeated here.

In step 220, according to the duty cycle and the gamma data corresponding to the first display brightness level and the duty cycle corresponding to the second display brightness level, or according to the duty cycle and the gamma data corresponding to the first display brightness level and the gamma data corresponding to the second display brightness level, maximum brightness corresponding to an inserted display brightness level and a corresponding duty cycle are determined. This step is the same as step 120 described in the preceding embodiment and is not repeated here.

In step 230, a plurality of binding-point grayscales in an ascending order is sorted, whether the binding-point grayscale among the plurality of binding-point grayscales having a greater position number than the preset grayscale threshold among the plurality of binding-point grayscales is determined, and when the binding-point grayscale among the plurality of binding-point grayscales has a greater position number than the preset grayscale threshold among the plurality of binding-point grayscales, the gamma register value corresponding to the binding-point grayscale is calculated according to the preset calculation formula.

For example, binding-point grayscales at a plurality of display brightness levels (including a maximum display brightness level, a minimum display brightness level and the inserted display brightness level) are the same. For example, the grayscale has a range of 0-255 grayscale, a plurality of binding-point grayscales is 0, 6, 12, 18, 24, 32, 64, 128, 220 and 255, respectively, and number positions corresponding to the plurality of binding-point grayscales are 1, 2, 3, 4, 5, 6, 7, 8, 9 and 10, respectively. For example, the preset grayscale threshold Gray[$k_{th}$] in the preceding embodiment has a position number of 3 among the plurality of binding-point grayscales, that is, $k_{th}$=3; the first binding-point grayscale Gray[$k_1$] has a position number of 6 among the plurality of binding-point grayscales, that is, k=6; and the second binding-point grayscale Gray[$k_2$] has a position number of 8 among the plurality of binding-point grayscales, that is, $k_2$=8. That is, a magnitude relationship between the binding-point grayscale and the preset grayscale threshold can be determined through determining the position number of the binding-point grayscale among the plurality of binding-point grayscales and the position number of the preset grayscale threshold among the plurality of binding-point grayscales. Similarly, a magnitude relationship between the binding-point grayscale and the first binding-point grayscale and a relationship between the binding-point grayscale and the second binding-point grayscale can be determined.

Figure 6:
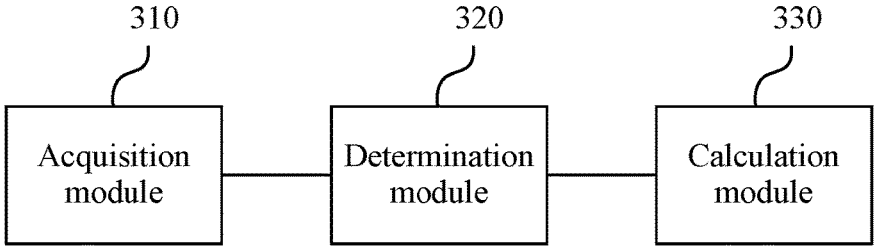
FIG. 6 is a structure diagram of a gamma debugging apparatus according to an embodiment of the present disclosure.

The present embodiment further provides a gamma debugging apparatus. FIG. 6 is a structure diagram of a gamma debugging apparatus according to an embodiment of the present disclosure. Referring to FIG. 6, the gamma debugging apparatus includes an acquisition module 310, a determination module 320 and a calculation module 330.

The acquisition module 310 is configured to acquire a duty cycle and gamma data at a first display brightness level and a duty cycle and gamma data at a second display brightness level in a PWM dimming interval. The first display brightness level is a maximum display brightness level in the PWM dimming interval, and the second display brightness level is a minimum display brightness level in the PWM dimming interval, or the first display brightness level is a minimum display brightness level in the PWM dimming interval, and the second display brightness level is a maximum display brightness level in the PWM dimming interval.

The determination module 320 is configured to determine maximum brightness corresponding to an inserted display brightness level and a duty cycle corresponding to the inserted display brightness level according to the duty cycle and the gamma data corresponding to the first display brightness level, and the duty cycle corresponding to the second display brightness level, or according to the duty cycle and the gamma data corresponding to the first display brightness level, and the gamma data corresponding to the second display brightness level.

The calculation module 330 is configured to determine whether a binding-point grayscale at the inserted display brightness level is greater than a preset grayscale threshold, and when the binding-point grayscale at the inserted display brightness level is greater than the preset grayscale threshold, calculate, according to a preset calculation formula, a gamma register value corresponding to the binding-point grayscale at the inserted display brightness level.

The preset grayscale threshold is determined by a difference value distribution between a gamma register value obtained by actually performing gamma debugging with a preset number of display modules at the inserted display brightness level and a gamma register value calculated according to an initial linear calculation formula; and the preset calculation formula is expressed as a formula obtained by correcting the initial linear formula according to the difference value distribution.

The initial linear formula satisfies the following condition: for a determined binding-point grayscale at the inserted display brightness level, the gamma register value obtained according to the initial linear formula is between a gamma register value corresponding to the determined binding-point grayscale at the minimum display brightness level and a gamma register value corresponding to the determined binding-point grayscale at the maximum display brightness level.

In the gamma debugging apparatus provided by the present embodiment, the determination module determines the maximum brightness corresponding to the inserted display brightness level and the duty cycle corresponding to the inserted display brightness level according to the duty cycle and the gamma data corresponding to the first display brightness level, and the duty cycle corresponding to the second display brightness level, or according to the duty cycle and the gamma data corresponding to the first display brightness level, and the gamma data corresponding to the second display brightness level, such that the duty cycle corresponding to the inserted display brightness level is determined without a need for debugging, thereby being conducive to saving time for adjustment; and the calculation module determines whether the binding-point grayscale at the inserted display brightness level is greater than the preset grayscale threshold, when the binding-point grayscale at the inserted display brightness level is greater than the preset grayscale threshold, the calculation module calculates, according to the preset calculation formula, the gamma register value corresponding to the binding-point grayscale at the inserted display brightness level, thereby reducing the number of binding-point grayscales on which gamma debugging needs to be performed at the inserted display brightness level, shortening the time for gamma debugging at the inserted display brightness level, shortening the time for gamma debugging in the entire PWM dimming interval and being conducive to improving the production capacity of the production line.

What is claimed is:

1. A gamma debugging method, comprising: acquiring a duty cycle and gamma data corresponding to a first display brightness level and a duty cycle and gamma data corresponding to a second display brightness level in a pulse-width modulation (PWM) dimming interval; wherein the first display brightness level is a maximum display brightness level in the PWM dimming interval, and the second display brightness level is a minimum display brightness level in the PWM dimming interval, or the first display brightness level is a minimum display brightness level in the PWM dimming interval, and the second display brightness level is a maximum display brightness level in the PWM dimming interval; according to the duty cycle and the gamma data corresponding to the first display brightness level, and the duty cycle corresponding to the second display brightness level, or according to the duty cycle and the gamma data corresponding to the first display brightness level, and the gamma data corresponding to the second display brightness level, determining maximum brightness corresponding to an inserted display brightness level and a duty cycle corresponding to the inserted display brightness level; determining whether a binding-point grayscale of a plurality of binding-point grayscales at the inserted display brightness level is greater than a preset grayscale threshold, in response to a determination result that the binding-point grayscale at the inserted display brightness level is greater than the preset grayscale threshold, calculating, according to a preset calculation formula, a gamma register value corresponding to the binding-point grayscale at the inserted display brightness level; wherein the preset grayscale threshold is determined by a difference value distribution between an actual gamma register value obtained by actually performing gamma debugging with a preset number of display modules at the inserted display brightness level and a calculated gamma register value calculated according to an initial linear calculation formula; and the preset calculation formula is performed as a formula obtained by correcting the initial linear calculation formula according to the difference value distribution; and wherein the initial linear calculation formula satisfies the following condition: for a determined binding-point grayscale of the plurality of binding-point grayscales at the inserted display brightness level, the calculated gamma register value calculated according to the initial linear formula is between a gamma register value corresponding to the determined binding-point grayscale at the minimum display brightness level and a gamma register value corresponding to the determined binding-point grayscale at the maximum display brightness level.

2. The method according to claim 1, wherein the gamma data comprises a brightness and a gamma register value corresponding to a binding-point grayscale; and the PWM dimming interval comprises a first level binding point to an m-th level binding point in sequence, wherein the maximum display brightness level is the first level binding point, the minimum display brightness level is the m-th level binding point, and the inserted display brightness level comprises a second level binding point to an (m−1)-th level binding point, wherein m≥3;

wherein the first display brightness level is the maximum display brightness level in the PWM dimming interval, and the second display brightness level is the minimum display brightness level in the PWM dimming interval; and wherein according to the duty cycle and the gamma data corresponding to the first display brightness level, and the gamma data corresponding to the second display brightness level, determining the maximum brightness corresponding to the inserted display brightness level and the duty cycle corresponding to the inserted display brightness level comprises:

according to a duty cycle and maximum brightness corresponding to the maximum display brightness level, and maximum brightness corresponding to the minimum display brightness level, determining the maximum brightness corresponding to the inserted display brightness level and the duty cycle corresponding to the inserted display brightness level;

wherein the maximum brightness corresponding to the inserted display brightness level is calculated according to the following formula:

$$L_q = \frac{L_1}{\lambda^{(q-1)}}, \text{ wherein } \lambda = \sqrt[(m-1)]{L_1 / L_m};$$

and wherein the duty cycle corresponding to the inserted display brightness level is calculated according to the following formula:

$$EM_q = \frac{EM_1}{\lambda^{(q-1)}};$$

wherein $L_q$ denotes maximum brightness corresponding to a q-th level binding point, q denotes an ordinal number of the brightness level and $2 \le q \le (m-1)$, $L_1$ denotes the maximum brightness corresponding to the maximum display brightness level, $L_m$ denotes the maximum brightness corresponding to the minimum display brightness level, m denotes a total brightness level, $EM_q$ denotes a duty cycle corresponding to the q-th level binding point, and $EM_1$ denotes the duty cycle corresponding to the maximum display brightness level.

3. The method according to claim 2, wherein the initial linear calculation formula is satisfied as:

$$V_{qk}=((q-1)*V_{mk}+(m-q)*V_{1k})/(m-1); \text{ and}$$

wherein in the initial linear calculation formula, $V_{qk}$ denotes a gamma register value corresponding to a k-th binding-point grayscale at the q-th level binding point, $V_{1k}$ denotes a gamma register value corresponding to a k-th binding-point grayscale at the first level binding point, $V_{mk}$ denotes a gamma register value corresponding to a k-th binding-point grayscale at the m-th level binding point and $1 \le k \le p$, wherein p denotes a total number of binding-point grayscales at the inserted display brightness level.

4. The method according to claim 3, wherein the preset calculation formula is satisfied as:

$$V'_{qk} = \frac{((q-1)*V_{mk} + (m-q)*V_{1k})}{(m-1)} + aGray[k] + b;$$

wherein in the preset calculation formula, $V'_{qk}$ denotes a gamma register value corresponding to the k-th binding-point grayscale at the q-th level binding point, a and b are determined by the difference value distribution between the actual gamma register value obtained by actually performing gamma debugging with the preset number of display modules at the inserted display brightness level and the calculated gamma register value calculated according to the initial linear calculation formula, and Gray[k] denotes a k-th binding-point grayscale at the inserted display brightness level; and wherein a process of determining a and b comprises:

according to the difference value between the gamma register value obtained by actually performing gamma debugging with the display modules at the inserted display brightness level and the gamma register value calculated according to the initial linear calculation formula, plotting a curve showing a relationship between the binding-point grayscale and the difference value; and according to slopes of curves showing relationships between binding-point grayscales corresponding to a plurality of display modules and difference values and a maximum difference value among difference values corresponding to the plurality of display modules at a same binding-point grayscale, determining a and b.

5. The method according to claim 4, wherein according to the slopes of the curves showing the relationships between the binding-point grayscales corresponding to the plurality of display modules and the difference values and the maximum difference value among the difference values corresponding to the plurality of display modules at the same binding-point grayscale, determining a and b comprises:

in a case where the binding-point grayscale is between the preset grayscale threshold and a first binding-point grayscale, determining a and b according to the following formulas:

$$a=(R_1-R_{th})/(\text{Gray}[k_1]-\text{Gray}[k_{th}])$$

and $$b=-(R_2-R_{th})*\text{Gray}[k_{th}]/(\text{Gray}[k_1]-\text{Gray}[k_{th}])+R_{th};$$

wherein $R_1$ denotes an average value of difference values corresponding to the plurality of display modules at the first binding-point grayscale at the inserted display brightness level, $R_{th}$ denotes an average value of difference values corresponding to the plurality of display modules at the preset grayscale threshold at the inserted display brightness level, Gray[$k_1$]denotes the first binding-point grayscale, and Gray[$k_{th}$] denotes the preset grayscale threshold, wherein $k_1>k_{th}$, $1\leq k_1\leq p$ and $1\leq k_{th}\leq p$;

wherein in a case where the binding-point grayscale is between the preset grayscale threshold and the first binding-point grayscale, curves showing relationships between two adjacent binding-point grayscales and the difference value have slopes which have a same sign; and wherein in a case where the binding-point grayscale is less than the preset grayscale threshold, the maximum value among the difference values corresponding to the plurality of display modules at the same binding-point grayscale being greater than a first difference value threshold; and in a case where the binding-point grayscale is greater than the preset grayscale threshold, the maximum value among the difference values corresponding to the plurality of display modules at the same binding-point grayscale being less than the first difference value threshold.

6. The method according to claim 5, wherein in a case where the binding-point grayscale is between the first binding-point grayscale and a second binding-point grayscale, determining a and b according to the following formulas:

$$a=(R_2-R_1)/(\text{Gray}[k_2]-\text{Gray}[k_1])$$

and $$b=-(R_2-R_1)*\text{Gray}[k_1]/(\text{Gray}[k_1])+R_1;$$

wherein $R_2$ denotes an average value of difference values corresponding to the plurality of display modules at the second binding-point grayscale at the inserted display brightness level, and Gray[$k_2$] denotes the second binding-point grayscale, wherein $1\leq k_2\leq p$ and $k_2>k_1$;

wherein in a case where the binding-point grayscale is between the first binding-point grayscale and the second binding-point grayscale, curves showing relationships between two adjacent binding-point grayscales and the difference value have slopes which have a same sign; and a curve showing a relationship between the preset grayscale threshold and the first binding-point grayscale and a curve showing a relationship between a binding-point grayscale between the first binding-point grayscale and the second binding-point grayscale and the difference value have slopes that have opposite signs;

wherein in a case where the binding-point grayscale is between the second binding-point grayscale and a maximum grayscale, a=0 and b=0; and wherein in a case where the binding-point grayscale is between the second binding-point grayscale and the maximum grayscale, at any binding-point grayscale, an absolute value of a difference value corresponding to the plurality of display modules is less than an absolute value of a preset difference value, wherein the absolute value of the preset difference value is less than an absolute value of a first difference value, and the first difference value is a difference value corresponding to a binding-point grayscale between the preset grayscale threshold and the second binding-point grayscale on a curve showing a relationship between the binding-point grayscale between the preset grayscale threshold and the second binding-point grayscale and the difference value.

7. The method according to claim 1, wherein the gamma data comprises a brightness and a gamma register value corresponding to a binding-point grayscale; and the PWM dimming interval comprises a first level binding point to an m-th level binding point in sequence in a descending order of a display brightness level, wherein the maximum display brightness level is the first level binding point, the minimum display brightness level is the m-th level binding point, and the inserted display brightness level comprises a second level binding point to an (m−1)-th level binding point, wherein $m\geq 3$;

wherein the first display brightness level is the minimum display brightness level in the PWM dimming interval, and the second display brightness level is the maximum display brightness level in the PWM dimming interval; and wherein according to the duty cycle and the gamma data corresponding to the first display brightness level, and the gamma data corresponding to the second display brightness level, determining the maximum brightness corresponding to the inserted display brightness level and the duty cycle corresponding to the inserted display brightness level comprises:

according to a duty cycle and maximum brightness corresponding to the minimum display brightness level, and maximum brightness corresponding to the maximum display brightness level, determining the maximum brightness corresponding to the inserted display brightness level and the duty cycle corresponding to the inserted display brightness level;

wherein the maximum brightness corresponding to the inserted display brightness level is calculated according to the following formula:

$$L_q = L_m * \lambda^{(m-q)}, \text{ wherein } \lambda = \sqrt[(m-1)]{L_1 / L_m};$$

and wherein the duty cycle corresponding to the inserted display brightness level is calculated according to the following formula:

$$EM_q 32 EM_m * \lambda^{(m-q)};$$

wherein $L_q$ denotes maximum brightness corresponding to a q-th level binding point, q denotes an ordinal number of the brightness level and $2\leq q\leq(m-1)$, $L_1$ denotes the maximum brightness corresponding to the maximum display brightness level, $L_m$ denotes the maximum brightness corresponding to the minimum display brightness level, m denotes a total brightness level, $EM_q$ denotes a duty cycle corresponding to the q-th level binding point, and $EM_m$ denotes the duty cycle corresponding to the minimum display brightness level.

8. The method according to claim 7, wherein the initial linear calculation formula is satisfied as:

$$V_{qk}=((q-1)*V_{mk}+(m-q)*V_{1k})/(m-1); \text{ and}$$

wherein in the initial linear calculation formula, $V_{qk}$ denotes a gamma register value corresponding to a k-th binding-point grayscale at the q-th level binding point, $V_{1k}$ denotes a gamma register value corresponding to a k-th binding-point grayscale at the first level binding point, $V_{mk}$ denotes a gamma register value corresponding to a k-th binding-point grayscale at the m-th level binding point and $1\leq k\leq p$, wherein p denotes a total number of binding-point grayscales at the inserted display brightness level.

9. The method according to claim 1, wherein the gamma data comprises a brightness and a gamma register value corresponding to a binding-point grayscale; and the PWM dimming interval comprises a first level binding point to an m-th level binding point in sequence in a descending order of a display brightness level, wherein the maximum display brightness level is the first level binding point, the minimum display brightness level is the m-th level binding point, and the inserted display brightness level comprises a second level binding point to an (m−1)-th level binding point, wherein m≥3;

wherein the first display brightness level is the maximum display brightness level in the PWM dimming interval, and the second display brightness level is the minimum display brightness level in the PWM dimming interval; and wherein according to the duty cycle and the gamma data corresponding to the first display brightness level, and the duty cycle corresponding to the second display brightness level, determining the maximum brightness corresponding to the inserted display brightness level and the corresponding duty cycle comprises:

according to a duty cycle and maximum brightness corresponding to the maximum display brightness level, and a duty cycle corresponding to the minimum display brightness level, determining the maximum brightness corresponding to the inserted display brightness level and the duty cycle corresponding to the inserted display brightness level;

wherein the maximum brightness corresponding to the inserted display brightness level is calculated according to the following formula:

$$L_q = \frac{L_1}{\lambda^{(q-1)}}, \text{ wherein } \lambda = \sqrt[(m-1)]{EM_1 / EM_m};$$

and wherein the duty cycle corresponding to the inserted display brightness level is calculated according to the following formula:

$$EM_q = \frac{EM_1}{\lambda^{(q-1)}};$$

wherein $L_q$ denotes maximum brightness corresponding to a q-th level binding point and 2≤q≤(m−1), $L_1$ denotes the maximum brightness corresponding to the maximum display brightness level, $EM_1$ denotes the duty cycle corresponding to the maximum display brightness level, $EM_m$ denotes the duty cycle corresponding to the minimum display brightness level, and $EM_q$ denotes a duty cycle corresponding to the q-th level binding point.

10. The method according to claim 9, wherein the initial linear calculation formula is satisfied as:

$$V_{qk}=((q-1)*V_{mk}+(m-q)*V_{1k})/(m-1); \text{ and}$$

wherein in the initial linear calculation formula, $V^{qk}$ denotes a gamma register value corresponding to a k-th binding-point grayscale at the q-th level binding point, $V_{1k}$ denotes a gamma register value corresponding to a k-th binding-point grayscale at the first level binding point, $V_{mk}$ denotes a gamma register value corresponding to a k-th binding-point grayscale at the m-th level binding point and 1≤k≤p, wherein p denotes a total number of binding-point grayscales at the inserted display brightness level.

11. The method according to claim 1, wherein the gamma data comprises a brightness and a gamma register value corresponding to a binding-point grayscale; and the PWM dimming interval comprises a first level binding point to an m-th level binding point in sequence in a descending order of a display brightness level, wherein the maximum display brightness level is the first level binding point, the minimum display brightness level is the m-th level binding point, and the inserted display brightness level comprises a second level binding point to an (m−1)-th level binding point, wherein m≥3;

wherein the first display brightness level is the minimum display brightness level in the PWM dimming interval, and the second display brightness level is the maximum display brightness level in the PWM dimming interval; and wherein according to the duty cycle and the gamma data corresponding to the first display brightness level, and the duty cycle corresponding to the second display brightness level, determining the maximum brightness corresponding to the inserted display brightness level and the corresponding duty cycle comprises:

according to a duty cycle and maximum brightness corresponding to the minimum display brightness level, and a duty cycle corresponding to the maximum display brightness level, determining the maximum brightness corresponding to the inserted display brightness level and the corresponding duty cycle; wherein the maximum brightness corresponding to the inserted display brightness level is calculated according to the following formula:

$$L_q = L_m * \lambda^{(m-q)}, \text{ wherein } \lambda = \sqrt[(m-1)]{EM_1 / EM_m};$$

and wherein the duty cycle corresponding to the inserted display brightness level is calculated according to the following formula:

$$EM_q=EM_m*\lambda^{(m-q)};$$

wherein $L_q$ denotes maximum brightness corresponding to a q-th level binding point and 2≤q≤(m−1), $L_m$ denotes the maximum brightness corresponding to the minimum display brightness level, $EM_1$ denotes the duty cycle corresponding to the maximum display brightness level, $EM_m$ denotes the duty cycle corresponding to the minimum display brightness level, $EM_q$ denotes a duty cycle corresponding to the q-th level binding point, and denotes the duty cycle corresponding to the minimum display brightness level.

12. The method according to claim 11, wherein the initial linear calculation formula is satisfied as:

$$V_{qk}=((q-1)*V_{mk}+(m-q)*V_{1k})/(m-1); \text{ and}$$

wherein in the initial linear calculation formula, $V_{1k}$ denotes a gamma register value corresponding to a k-th binding-point grayscale at the q-th level binding point, $V_{ik}$ denotes a gamma register value corresponding to a k-th binding-point grayscale at the first level binding point, $V_{mk}$ denotes a gamma register value corresponding to a k-th binding-point grayscale at the m-th level binding point and 1≤k≤p, wherein p denotes a total number of binding-point grayscales at the inserted display brightness level.

13. The method according to claim 1, wherein determining whether the binding-point grayscale at the inserted display brightness level is greater than the preset grayscale threshold, and in response to the determination result that the binding-point grayscale at the inserted display brightness level is greater than the preset grayscale threshold, calculating, according to the preset calculation formula, the gamma register value corresponding to the binding-point grayscale at the inserted display brightness level comprises:

sorting a plurality of binding-point grayscales in an ascending order, determining whether the binding-point grayscale among the plurality of binding-point grayscales has a greater position number than the preset grayscale threshold among the plurality of binding-point grayscales, and in response to a determination result that the binding-point grayscale among the plurality of binding-point grayscales has a greater position number than the preset grayscale threshold among the plurality of binding-point grayscales, calculating, according to the preset calculation formula, the gamma register value corresponding to the binding-point grayscale at the inserted display brightness level.

14. The method according to claim 1, further comprising: in response to a determination result that the binding-point grayscale at the inserted display brightness level is less than or equal to the preset grayscale threshold, performing, at the inserted display brightness level, gamma debugging on the binding-point grayscale to obtain a gamma register value corresponding to the binding-point grayscale.

15. The method according to claim 1, wherein at a same inserted display brightness level, the preset grayscale threshold satisfies the following conditions: when the binding-point grayscale is less than the preset grayscale threshold, a maximum difference value among difference values corresponding to a plurality of display modules at a same binding-point grayscale is greater than a first difference value threshold; and in a case where the binding-point grayscale is greater than the preset grayscale threshold, the maximum value among the difference values corresponding to the plurality of display modules is less than the first difference value threshold.

16. The method according to claim 1, wherein for a gamma register value corresponding to a determined binding-point grayscale greater than the preset grayscale threshold at the inserted display brightness level, the initial linear calculation formula represents a linear calculation formula for the gamma register value corresponding to the determined binding-point grayscale at the maximum display brightness level and the gamma register value corresponding to the determined binding-point grayscale at the minimum display brightness level.

17. The method according to claim 1, wherein the greater the inserted display brightness level is, the less the preset grayscale threshold corresponding to the inserted display brightness level is.

* * * * *